US006009386A

United States Patent [19]

Cruickshank et al.

[11] Patent Number: 6,009,386

[45] Date of Patent: Dec. 28, 1999

[54] SPEECH PLAYBACK SPEED CHANGE USING WAVELET CODING, PREFERABLY SUB-BAND CODING

[75] Inventors: Brian Cruickshank, Oakville; Lin Lin, Toronto, both of Canada

[73] Assignee: Nortel Networks Corporation, Montreal, Canada

[21] Appl. No.: 08/980,451

[22] Filed: Nov. 28, 1997

[51] Int. Cl.[6] ..... G10L 3/02; G10L 7/04

[52] U.S. Cl. ..... 704/207; 704/211; 704/500

[58] Field of Search ..... 704/211, 500, 704/501, 502, 503, 504, 201, 203, 205, 207, 265, 267, 268

[56] References Cited

U.S. PATENT DOCUMENTS

| | | | |
|---|---|---|---|
| 4,586,191 | 4/1986 | Nishimura | 704/258 |
| 5,386,493 | 1/1995 | Degen et al. | 704/267 |
| 5,388,182 | 2/1995 | Benedetto et al. | 704/205 |
| 5,495,554 | 2/1996 | Edwards et al. | 704/205 |
| 5,583,652 | 12/1996 | Ware | 386/75 |
| 5,630,005 | 5/1997 | Ort | 386/69 |
| 5,659,539 | 8/1997 | Porter et al. | 395/200 |
| 5,671,330 | 9/1997 | Sakamoto et al. | 704/268 |
| 5,781,881 | 7/1998 | Stegmann | 704/214 |
| 5,819,215 | 10/1998 | Dobson et al. | 704/230 |
| 5,822,370 | 10/1998 | Graupe | 704/500 |
| 5,828,994 | 10/1998 | Covell et al. | 704/211 |
| 5,845,243 | 12/1998 | Smart et al. | 704/230 |

OTHER PUBLICATIONS

"Sub–Band Coding" by R.E. Crochiere, published in the *Bell System Technical Journal*, vol. 60, No. 7, Sep. 1981, pp. 1633 to 1651.

*Primary Examiner*—David R. Hudspeth
*Assistant Examiner*—Martin Lerner

[57] ABSTRACT

A method of speeding up playback of a digitized audio signal without raising the pitch and without introducing discontinuities in the speech signal, comprises sub-band coding (SBC) consecutive blocks of the audio signal with standard SBC or wavelet compression to derive frames of data. Next periodic adjacent pairs of the frames are dropped to leave a stream of remaining frames. A sped up approximation of the digitized audio signal is then reconstructed by sub-band decoding consecutive remaining frames. The method can also be used to slow speech playback by replicating, rather than dropping, adjacent pairs of frames.

12 Claims, 4 Drawing Sheets

SPEECH PLAYBACK SPEED CHANGE USING WAVELET CODING, PREFERABLY SUB-BAND CODING

BACKGROUND OF THE INVENTION

This invention relates to a method and apparatus for changing the speed of playback of a digitised audio signal.

Speech falls within a frequency range between 20 Hz and 4 kHz. According to Nyquist's theorem, an analog signal must be sampled at a rate at least twice that of the highest frequency component of the signal in order to preserve information in the signal. Accordingly, to digitise speech, the analog speech signal is conventionally sampled at the rate of 8 kHz. The analog samples are typically digitally encoded using pulse code modulation (PCM).

Because humans are often able to comprehend at a rate faster than normal human speech, it may be desired to speed up recorded speech during playback. This could be accomplished by simply increasing the rate of playback of PCM samples, however this would raise the pitch of the played back speech. To avoid raising the pitch, it is known to drop groups of PCM samples from a sample stream and playback the remaining samples at the normal rate of 8 kHz. However, this results in clicks in the playback due to the discontinuities between speech samples preceding and following the dropped speech samples.

In U.S. Pat. No. 5,386,493 issued Jan. 31, 1995 to Degen, periodic groups of samples are dropped from a digital sample stream and the resulting gaps removed. Discontinuities at the cut points are avoided by filtering the digital sample stream with an equal-powered cross-fade amplifier/filter. This filter fades out the old segment of samples utilizing a parabolic function while fading in the new segment. With cross-fade, the parabolic functions for each pair of adjacent segments cross at the segment junction (resulting in a cross-over region). This approach requires additional processing power to speed up the speech playback beyond that required to play back the signal at its normal (non-sped up) rate. The amount of additional processing power required becomes significant when the playback speedup is performed as part of a system which is playing back speech which was previously compressed (i.e. stored at a lower bit rate than the original). In this type of system, the need to expand out not only the speech samples in the segments being played, but also the samples in the cross-over region and, for some types of coders which are adaptive and/or differential, the samples in the segments that are dropped, can result in over twice the processing power of normal speed playback in order to double the playback speed.

This invention seeks to overcome drawbacks of prior systems to change the speed of audio playback, especially where there is a need to store the audio to be played back in a compressed format.

SUMMARY OF INVENTION

According to the present invention, there is provided a method of changing the playback speed of a digitised time domain audio signal which has been transformed into a wavelet coded audio signal comprising a stream of frames, comprising the steps of: selecting periodic ones of frames of said stream of wavelet coded frames modifying said stream of wavelet coded frames by dropping said selected frames from said wavelet coded audio signal to leave a modified stream of frames or replicating said selected frames in said wavelet coded audio signal to form a modified stream of frames; wavelet decoding consecutive frames of said modified stream of frames to construct a modified time domain signal which approximates pitch of said digitised time domain audio signal but has a different playback speed.

According to another aspect of the present invention, there is provided apparatus for changing the speaking rate in respect of a digitised time domain audio signal which has been transformed into a wavelet coded audio signal comprising a stream of wavelet coded frames, comprising: means for selecting periodic pairs of adjacent frames of said wavelet coded audio signal; means for modifying said wavelet coded audio signal by dropping said selected pairs of adjacent frames from said wavelet coded audio signal to leave a stream of frames or replicating said selected pairs of adjacent frames in said wavelet coded audio signal to form a stream of frames including each replicated pair of adjacent frames; and means for wavelet decoding consecutive frames of said modified stream of frames to construct a modified digitised time domain audio signal which, on playback, approximates pitch of said digitised time domain audio signal but has a different speaking rate.

BRIEF DESCRIPTION OF THE DRAWINGS

In the figures which illustrate preferred embodiments of the invention.

DETAILED DESCRIPTION OF THE PREFERRED EMBODIMENTS

Figure 1:
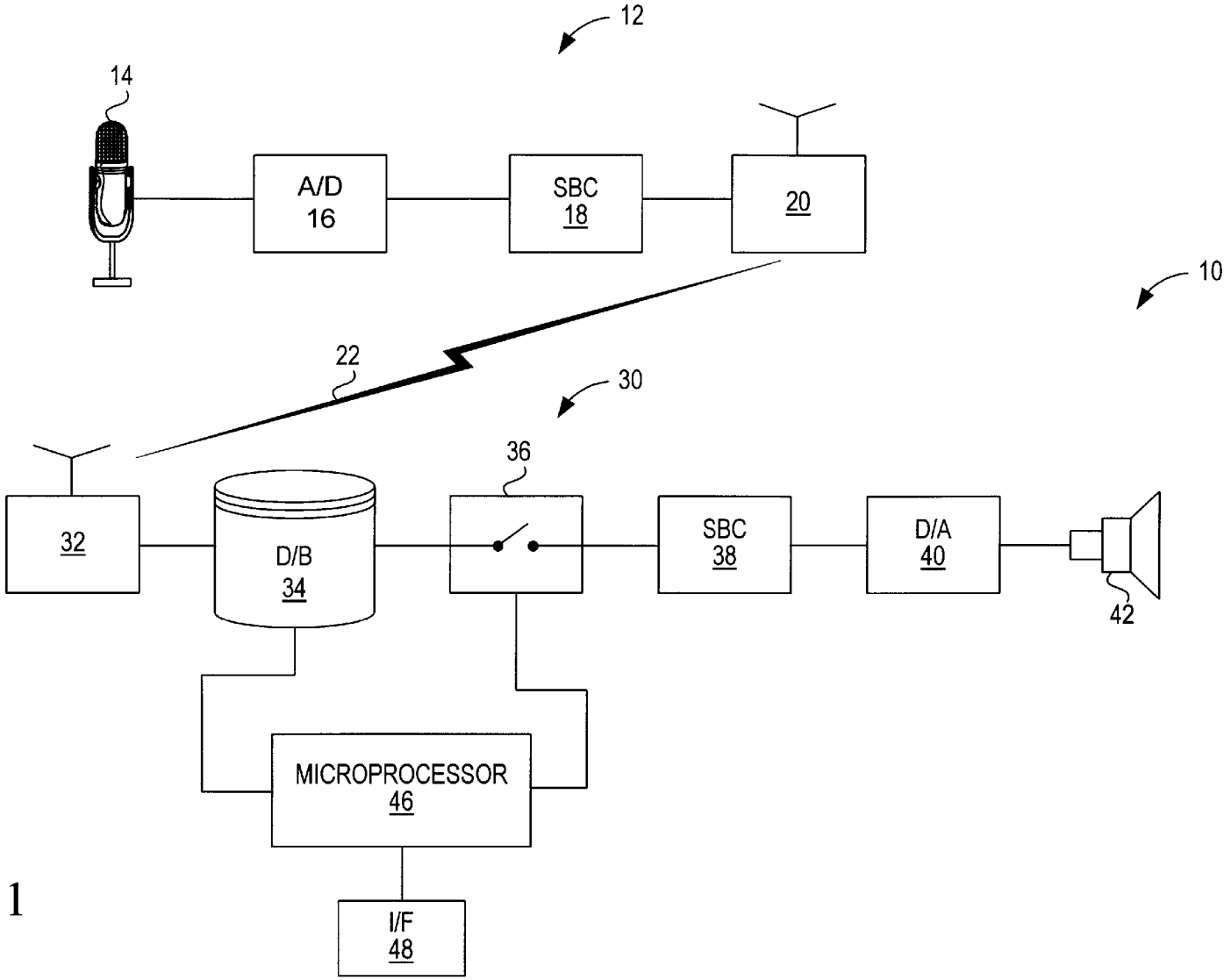
FIG. 1 is a sehematic illustration of a communication system made in accordance with this invention.

FIG. 1 illustrates a communication system 10 made in accordance with the subject invention. A transmitting telephone station 12 of the system comprises a serially arranged microphone 14, speech PCM digitiser 16, sub-band coder 18, and transmitter 20. A receiving voice mail station 30 comprises a serially arranged receiver 32, data store 34, selector 36, sub-band decoder 38, PCM to analog converter 40, and speaker 42. The data store 34 and selector 36 are connected to a processor 46 and the processor is input by a user interface 48. The transmitting station and receiving voice mail station are connected by a communication path 22.

The sub-band coder 18 and sub-band decoder 38 make use of sub-band coding (SBC). SBC is a known method to facilitate compression of PCM speech samples in order to increase the information throughput over any given communication pathway and/or to reduce the storage requirements for storing the speech samples in a computer's memory or hard disk. SBC relies on the fact that the human ear is more sensitive to lower frequencies and less sensitive to higher frequencies so that if some higher frequency components of a speech signal are reproduced with less fidelity, the signal is still understandable. In overview, SBC with compression is accomplished as follows. A PCM speech signal is organised into consecutive blocks of samples. Each block is then filtered to obtain sub-blocks of filtered samples with each sub-block comprising frequency components of the original signal which fall within a certain frequency band. Sub-blocks are then recoded using fewer bits, or dropped altogether to compress the signal. In this regard, the sub-bands representing higher frequency bands are the ones which may be dropped and, further, if they are retained, then the recoding applied to the samples of these higher frequency bands may result in a greater bit reduction than that for the samples of the lower frequency bands. A number of different techniques are known for accomplishing this bit reduction. The remaining sub-blocks are organised into a frame which is sent to the receiver. At the receiver, each data frame is decompressed and filtered to reconstruct an approximation of the original block from which the frame was derived.

Sub-band coding is detailed in numerous sources as, for example, an article by R. E. Crochiere entitled "Sub-Band Coding" published in the *Bell System Technical Journal*, Vol. 60, No. 7, September 1981, pages 1633 to 1651, the contents of which are incorporated by reference herein.

Figure 2:
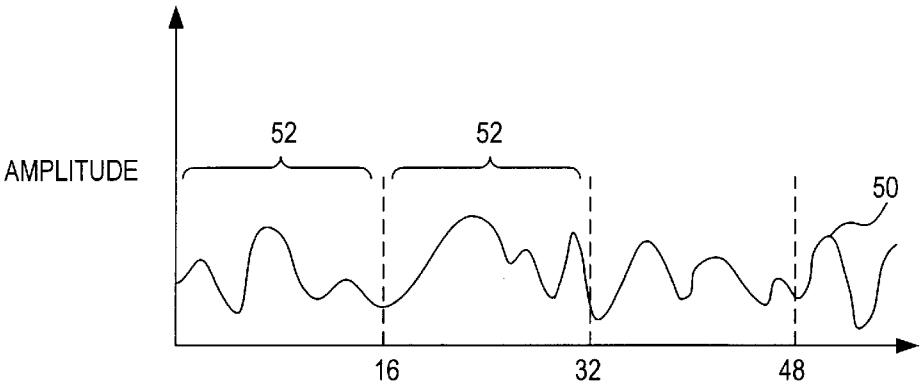
FIG. 2 is a time versus amplitude graph of speech.
Figure 3:
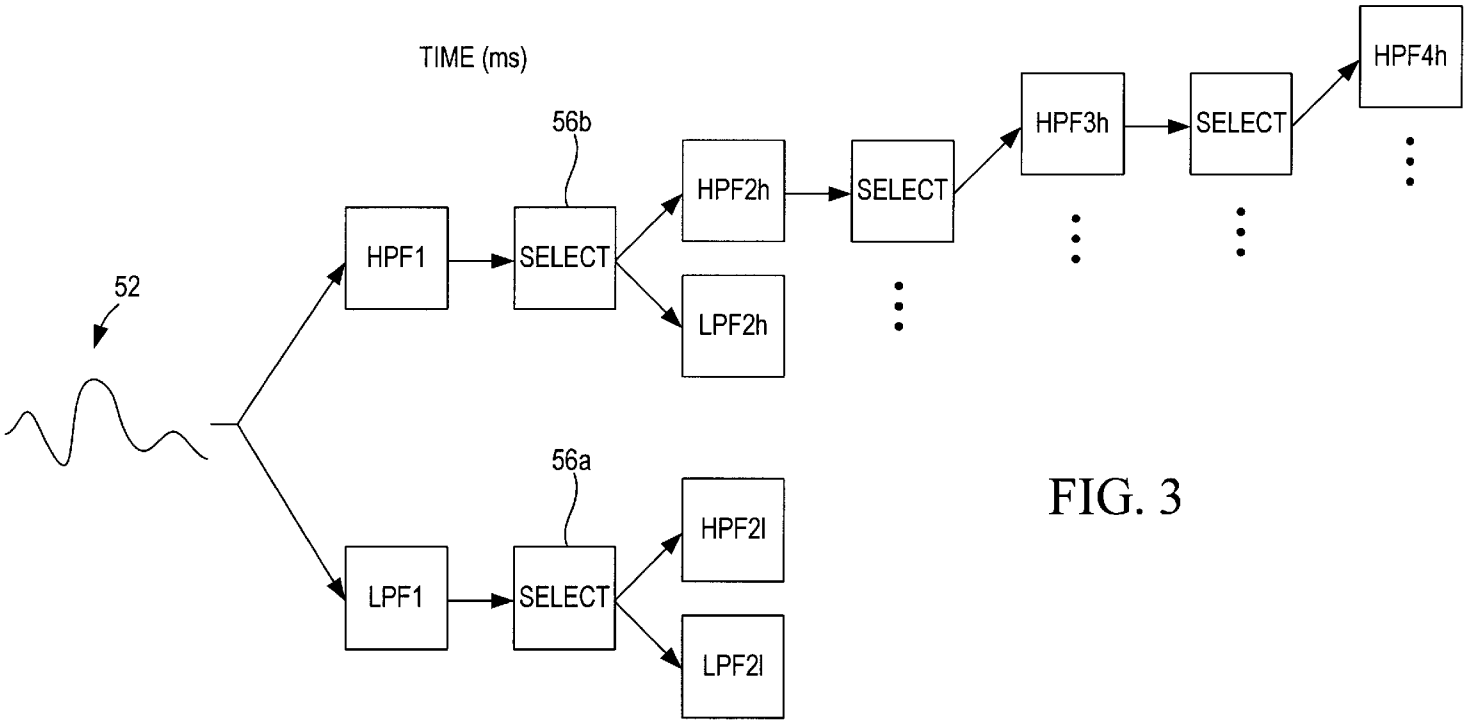
FIG. 3 is a schematic detail of a portion of FIG. 1.

In operation of the system of FIG. 1, a caller at the transmitting telephone station 12 may leave a message on the receiving voice mail station 30 by speaking into the microphone 14. The speech digitiser 16 samples the speech from the output of the microphone at a rate of 8 kHz and constructs a stream of PCM time domain samples. Referencing FIG. 2, the sub-band coder 18 organises the PCM stream into sixteen millisecond blocks 52 of samples of the PCM speech signal 50. Given that the sampling rate is 8 kHz, each block comprises 128 samples. Turning to FIG. 3, each block 52 is then filtered by a low pass filter (LPF), LPF1, having a cut-off frequency of 2 kHz. The 128 samples output from the LPF make up a signal having frequency components up to 2 kHz; thus, the highest frequency component in the low pass samples is at most half that of samples input to the filter. Consequently, according to Nyquist's theorem, only one-half the 128 samples are needed to preserve the information in the low pass signal. Every other low pass signal sample is therefore dropped in a sample selector 56*a* so that there are sixty-four low pass samples at the output of the sample selector. Similarly, each block is also filtered by a high pass filter (HPF), HPF1, also having a cut-off frequency of 2 kHz. The high pass signal output from HPF1 is then passed to a selector 56*b* which outputs every other sample to derive sixty-four high pass samples. The selected high pass samples have frequency components between 2 and 4 kHz.

From the foregoing, it will he apparent that while each of the selected low pass signal samples and the selected high pass signal samples have one-half of the frequency content of the original signal block, together they contain the entire frequency content of the original signal block and therefore provide sufficient information to reconstruct the signal block.

The sixty-four selected low pas samples are passed to each of a second LPF, LPF2l, and to a second HPF, HPF2l, both having a cut-off frequency of 1 kHz. Every other sample output from LPF2l and from HPF2l is selected resulting in thirty-two selected LPF2l samples and thirty-two selected HPF2l samples. Similarly, the sixty-four selected high pass samples are passed to each of another LPF, LPF2h, and to another HPF, HPF2h, each with a cut-off frequency of 3 kHz, and thirty-two samples selected from the output of each filter. The result is four sub-blocks of samples, each with frequency components spanning 1 kHz.

The same process is repeated again for each of the four sub-blocks of thirty-two, samples resulting in eight sub-blocks of sixteen samples, each sub-block having frequency components spanning 500 Hz. And the process is repeated one further time to obtain sixteen sub-blocks, each with eight samples and each having frequency components spanning 250 Hz.

In view of the fact that telephone codecs have a handpass region of 0–3.4 kHz and filter out frequencies above 3.4 kHz, the sub-band codes 18 is programmed to compress the decomposed signal by dropping the eight sample sub-blocks with frequency components from 3,500 Hz to 3,750 Hz and the eight sample sub-blocks with frequency components from 3,750 to 4,000 Hz. Further, in view of the relative insensitivity of the human ear to higher frequencies, the eight sample sub-blocks in the 1,000–3,500 Hz bands are recoded with a smaller number of bits than remain in the sub-blocks of the 0–1,000 Hz bands after recoding. The remaining sub-blocks are organised into a frame of data and this frame of data is sent from the transmitter 20 over the communication path 22. The same process is then repeated for each consecutive block of data, again dropping the sub-blocks with the frequency components from 3.5 to 4 kHz and bit reducing the other sub-blocks.

Each of the filters of sub-band coder 18 is a finite impulse response (FIR) filter. As will be appreciated by those skilled in the art, such a filter is a weighted running average filter. Thus, the filter has a first in first out (FIFO) buffer which stores a number of samples equal to the number in the sub-block (or block) which it processes. For example, each of the HPFs and LPFs processing the four thirty-two sample sub-blocks have buffers storing thirty-two samples. At the start of processing, the FIFO buffer of a filter is filled with samples from the sub-block processed by the filter during processing of the previous block of data. As processing of the current sub-block proceeds, samples from the previous frame are dropped and samples from the current frame are stored in the filter buffer so that at the end of processing of the current sub-block, the filter is filled with the samples of the current sub-block.

As the SBC frames reach the receiver 32 of the receiving voice mail station 30, the frames are stored in the data store 34 under control of the processor 46. When a user wishes to hear a stored message, he may so indicate to the processor 46 via the user interface 48. This prompts the processor to address the data store in order to retrieve SBC frames which then pass through the selector 36 and sub-band decoder 38; the decoded blocks then pass to the digital to analog convertor 40 and analog speech is heard over the speaker 42.

Figure 4:
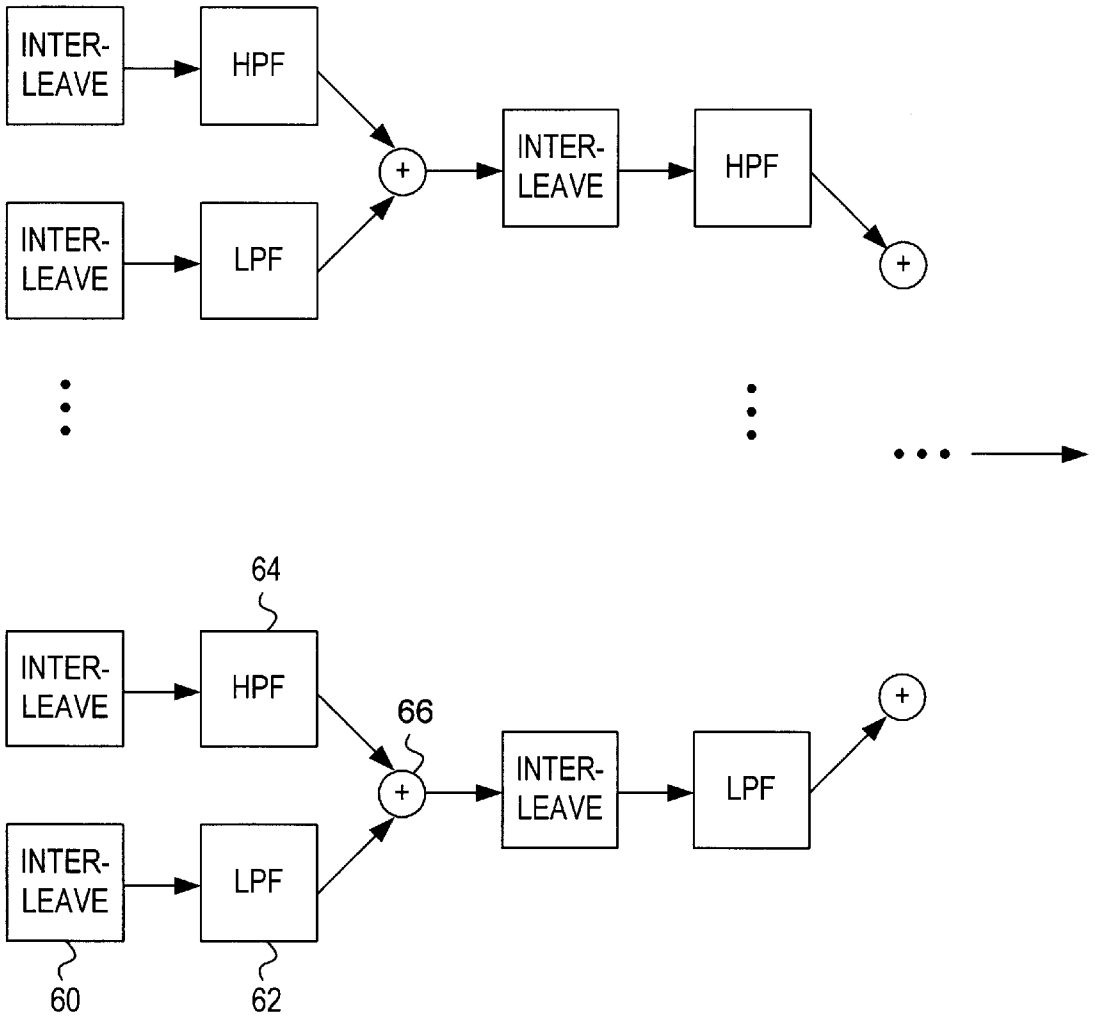
FIG. 4 is a schematic detail of another portion of FIG. 1.

If the user does not indicate through the user interface that he wishes to speed up playback, then the processor 46 does not activate the selector 36 and the unaltered SBC frame stream enters the sub-band decoder 38. With reference to FIG. 4, the sub-band decoder reconstructs an approximation of each original block of PCM samples as follows. For each of the sub blocks in a data frame, the eight samples are unencoded (decompressed) back to their original number of bits. The unencoding of the bit reduced sample introduces some error or noise into the signal which is greater for the more severely bit reduced samples in the higher frequency sub-blocks. However, this loss of fidelity in the higher frequencies is masked by the psycho-acoustic phenomenon mentioned previously. Zero-valued samples are interleaved into the eight samples of the sub-block in interleaver 60 resulting in sub-blocks having sixteen samples. Then, the sub-block containing frequency components of the original signal of from 0 to 250 Hz is passed through an FIR LPF 62 having a cut-off frequency of 250 Hz and the sub-block containing frequency components of the original signal of from 250 to 500 Hz is passed through an FIR HPF 64 having a cut-off frequency of 250 Hz. The output of those two filters is then summed in summer 66 resulting in a sixteen sample sub block having frequency components of from 0 to 500 Hz. The same process is repeated for the other pairs of sub-blocks to obtain sub-blocks with frequency components of from 500 to 1,000 Hz, from 1,000 to 1,500 Hz and so on up to 3,500 Hz. Next, for each of the resulting sub-blocks, zero-valued samples are interleaved to produce sub-blocks with thirty-two samples. Then pairs of sub-blocks are filtered by FIR filters and summed to result in sub-blocks each having frequency components spanning 1,000 Hz. The process is repeated twice more to construct a single block having frequency components of from 0 to 3,500 Hz. This single block is an approximation of the original block.

If, alternatively, the user wished to speed up playback (i.e., speed up the speaking rate) by 50%, he may send all appropriate indication in this regard to the processor via the user interface 48. This causes the processor to control the selector such that it drops every third adjacent pair of frames. Thus, if the SBC frames of the stored message were numbered #1, #2, #3, #4, #5, #6, #7, #8, #9, #10, #11, #12, #13, #14, #15, #16, #17, and #18, the frames leaving the selector would be frames numbered #1, #2, #3, #4, #7, #8, #9, #10, #13, #14, #15, and #16.

When the sub-band decoder 38 begins processing frame #7, the buffers of each of its FIR filters are filled with samples from the previous frame which it processed, namely, frame #4. In consequence of this, the FIR filters act to smooth the discontinuities between frame #4 and frame #7 which resulted from dropping frames #5 and #6. More particularly, the filtering action of each of the sub-band filters localizes the discontinuities between frames to only those frequency bands that contain active frequency components. Thus, for voice, instead of the discontinuity sounding like a "click" with a wide range of frequencies, the discontinuity is restricted to a set of frequency components which are around those frequencies that are in the voice waveform, and is therefore perceived as being part of the voice waveform itself. Additionally, the phases of each of the frequency sub-bands are independent of each other, and so they do not constructively interfere at the discontinuity the way a click does. Accordingly, the reconstructed PCM sample stream suppresses "clicks" while playing back the speech 50% more quickly than the original speech signal.

A user may also indicate through the user interface a desire to speed playback by 100%: in such instance, the processor controls the selector such that it drops every other pair of frames. With speech sped up 100%, the user could indicate through the user interface a desire to drop the speed-up to 50% or to return the speed to normal. Of course the receiving station 30 may be arranged to allow for other degrees of playback speed-up based on dropping different sequences of frame pairs.

It is preferred to drop periodic pairs of adjacent frames in selector 36 rather than periodic individual frames as it has been found the latter approach results in an apparent warble in the reconstructed speech signal. Dropping more than two consecutive frames is also not preferred since it results in the loss of too much speech information causing entire syllables to be lost from the speech.

Note that the greater the number of sub-bands, the more smoothly the voice can be speeded up. Thus, a sub-band coder which coded down to 125 Hz bands would have improved performance at discontinuities than the described sub-band decoder which codes down to 250 Hz. Furthermore, in applications where a lesser performance at discontinuities is acceptable, the sub-band coder may code down to frequency bands which are larger than 250 Hz.

The subject invention has applications in communications systems where the transmitting telephone station does not use SBC. For example, turning to FIG. 5, communication system 100 comprises a number of analog telephones 112 are also connected to the public switched telephone network (PSTN) 122. A receiving voice mail station 130 made in accordance with this invention is also connected to the PSTN. The receiving voice mail station comprises a serially arranged analog receiver 132, a speech PCM digitiser 116, sub-band coder 118, a data store 134, selector 136, sub-band decoder 138, PCM to analog converter 140, and speaker 142. The data store 134 and selector 136 are connected to a processor 146 and the processor is input by a user interface 148.

In operation of the communication system 100, a caller from an analog telephone station 112*a* is connected through to the receiving voice mail station 130. The caller's speech is received by the receiver 132, digitised to PCM samples by digitiser 116, Sub-band coded into frames of SBC data by sub-band coder 118 (which includes bit reducing recoding), and stored in data store 134. When a user wishes to hear the stored message, he may so indicate via the user interface 148 and may also select a playback speed. Based on this, the processor 146 controls the data store to read out the SBC frames and selector 136 to drop appropriate pairs of frames. The remaining frames then enter the sub-band decoder 138 where an approximation of the PCM stream derived at speech PCM digitiser 116 is reconstructed. This reconstruction then passes to PCM to analog convertor 140 and on to speaker 142 which plays the speech signal.

Figure 5:
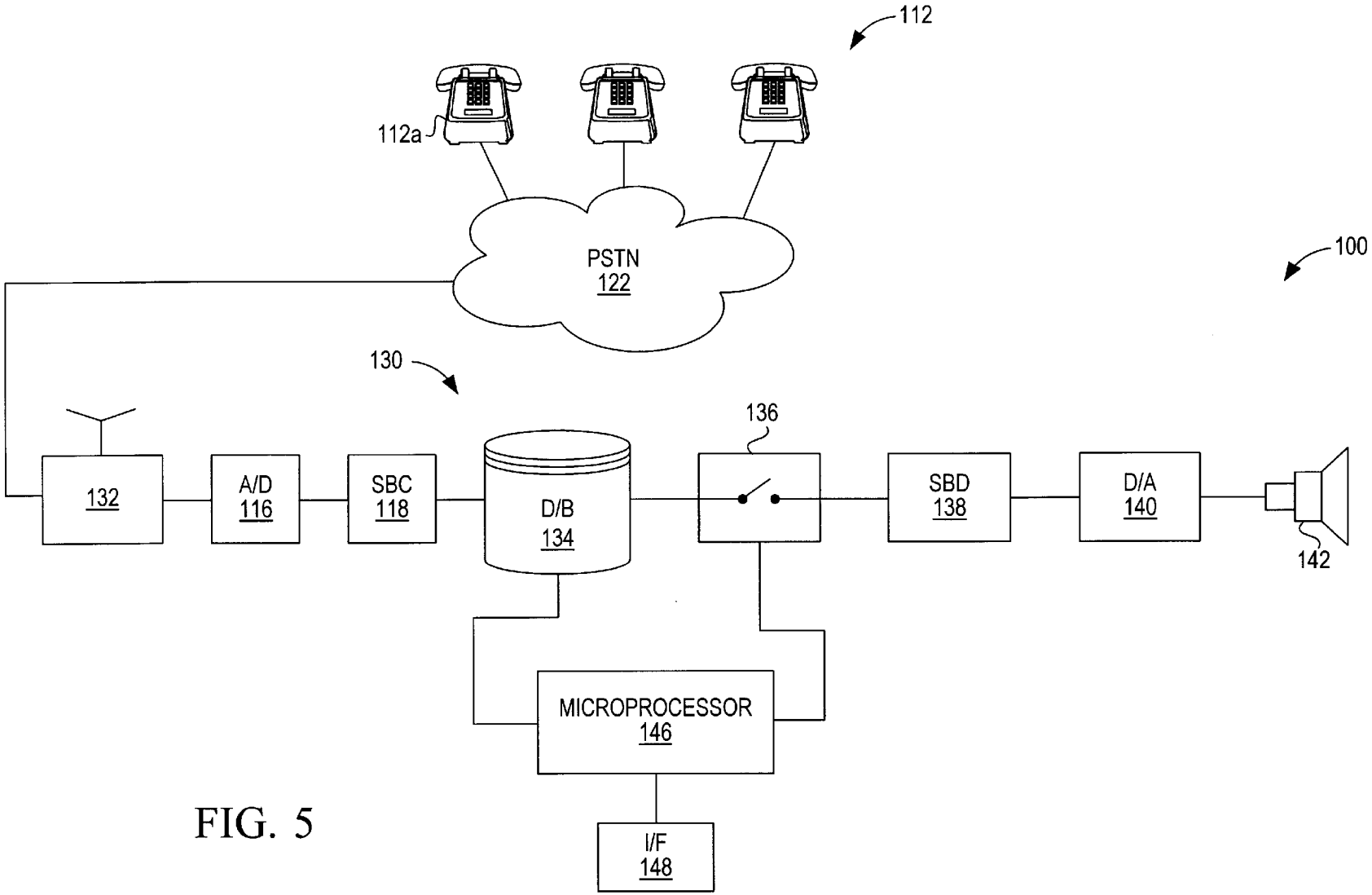
FIG. 5 is a schematic illustration of another communication system made in accordance with this invention.

It will be apparent that the system of FIG. 5 makes use of SBC not only to avoid "clicks" in the play back of sped up speech but also to facilitate compression of speech signals before they are stored in data store 134, thereby reducing memory and disk space requirements.

A generalisation of sub-band coding which may be employed in the subject invention in place of SBC is wavelet coding. Wavelet coding is accomplished in an identical manner to standard SBC except that where standard SBC uses FIR filters which split the speech signal into a set of equal frequency bands, wavelet speech coding uses FIR filters which may split the speech signal into a set of exponentially larger frequency bands, for example: 0 to 50 Hz; 50 to 100 Hz; 100 to 200 Hz, 200 to 400 Hz, and so on. Wider frequency bands are represented by more samples than narrower frequency bands. Wavelet decoding is accomplished in an identical fashion to SBC decoding except that a set of FIR filters is used which recombine the signal from a set of exponentially larger frequency bands. Wavelets thus offer finer temporal localization of frequency characteristics than does standard SBC. This is advantageous when compressing the speech signal.

While the embodiments of FIGS. 1 and 5 of the subject invention are adapted to speed up speech playback in a voice mail system, it will be apparent that the invention could equally be used to speed up other audio signals. In such case, it may be desired to adjust the sampling rate and the standard SBC or wavelet compression if the frequency range to be retained by the system differed from that retained for speech. An example alternate application is in the area of video signals. SBC is used for the audio portion of some video signals, such as MPEG video. A number of techniques exist for speeding up video images. The receiving station 30 of FIG. 2 could be directly employed in selectively speeding up the audio portion of such a signal so that, in conjunction with techniques for video image speed up, the entire video signal may be sped up.

The aforedescribed systems of FIGS. 1 and 5 may be used to slow down speech rather than speeding up speech. This is accomplished by instructing the selector 36, 136 to insert frames rather than drop frames. More particularly, a user could indicate through the interface 48, 148 he wished speech slowed down by 50%. The processor 46, 146 would respond by controlling the selector 36, 136 to replicate every third adjacent pair of frames such that these replicated frames followed the original frames in the frame stream. Thus, if the SBC frames of the stored message were numbered #1, #2, #3, #4, #5, #6, #7, #8, #9, #10, #11, #12, #13, #14, #15, #16, #17, and #18, the frames leaving the selector would be frames numbered #1, #2, #3, #4, #5, #6, #5, #6, #7, #8, #9, #10, #11, #12, #11, #12, #13, #14, #15, #16, #17, #18, #17, #18. To facilitate frame insertion, the selector may include a buffer for temporarily storing, and therefore replicating, selected frames.

While the digitised audio signal has been described as a PCM signal, the invention would work with other digitising schemes.

Other modifications will be apparent to those skilled in the art and, therefore, the invention is defined in the claims.

What is claimed is:

1. A method of changing the playback speed of a digitised time domain audio signal which has been transformed into a wavelet coded audio signal comprising a stream of frames, comprising:

selecting periodic ones of frames from said stream of wavelet coded frames;

modifying said stream of wavelet coded frames by dropping said selected frames from said wavelet coded audio signal to leave a modified stream of frames or by replicating said selected frames and including said replicated frames in said wavelet coded audio signal to form a modified stream of frames;

wavelet decoding consecutive frames of said modified stream of frames to construct a modified time domain signal which approximates pitch of said digitised time domain audio signal but has a different playback speed.

2. The method of claim 1 wherein the step of selecting periodic ones of said frames comprises selecting periodic pairs of adjacent frames.

3. The method of claim 1 further comprising receiving a user input indicating a period for said selecting step.

4. A method of operating upon a wavelet coded audio signal comprising stream of frames in order to slow the speaking rate in respect of a digitised time domain signal from which said wavelet coded audio signal was derived comprising:

replicating periodic ones of said frames in said stream of frames and including said replicated frames in said wavelet coded audio signal to form a modified stream of frames with periodic adjacent identical sequences of frames;

wavelet decoding consecutive frames of said modified stream of frames to construct a modified time domain signal which, when played back, approximates pitch of said digitised time domain audio signal but has a slower speaking rate.

5. A method of speeding up playback of a digitised time domain audio signal, comprising:

wavelet encoding by progressively filtering each of consecutive blocks of said time domain audio signal with finite impulse response (FIR) low pass filters (LPFs) and with FIR high pass filters (HPFs) to obtain, for each block, a plurality of wavelet domain sub-blocks, each wavelet domain sub-block of said plurality of wavelet domain sub-blocks having audio signal samples spanning a frequency band;

building a plurality of wavelet domain data frames, each wavelet domain data frame built from a plurality of wavelet domain sub-blocks derived from a given time domain block;

dropping periodic ones of said wavelet domain data frames to leave a stream of remaining wavelet domain data frames;

filtering consecutive frames in said stream of remaining wavelet domain data frames with FIR LPFs and FIR HPFs to construct a time domain signal which, on playback, approximates pitch of said digitised time domain audio signal but has a faster speaking rate.

6. The method of claim 5 wherein the step of dropping periodic ones of said frames comprises dropping periodic pairs of adjacent frames.

7. The method of claim 5 wherein the step of progressively filtering comprises:

filtering consecutive blocks of said audio signal with a first finite impulse response (FIR) low pass filter (LPF) to obtain consecutive once filtered LPF sub-blocks;

filtering consecutive blocks of said audio signal with a first FIR high pass filter (HPF) to obtain consecutive once filtered HPF sub-blocks;

filtering consecutive once filtered LPF blocks with a second FIR LPF to obtain consecutive twice filtered LPF sub-blocks; and filtering consecutive once filtered LPF blocks with a second FIR HPF to obtain consecutive twice filtered HPF sub-blocks.

8. The method of claim 5 wherein said step of building a plurality of wavelet domain data frames, each wavelet domain data frame built from a plurality of wavelet domain sub-blocks derived from a given time domain block comprises building each wavelet domain data frame from a selected sub-set of said plurality of wavelet domain sub-blocks.

9. A method of changing the speaking rate in respect of a digitised time domain audio signal which has been transformed into a wavelet coded audio signal comprising a stream of wavelet coded frames, comprising:

selecting periodic pairs of adjacent frames in said stream of wavelet coded frames;

modifying said stream of wavelet coded frames by dropping said selected pairs of adjacent frames from said stream of wavelet coded frames to leave a modified stream of frames or replicating said selected pairs of adjacent frames and including said replicated frames in said wavelet coded audio signal to form a modified stream of wavelet coded frames;

wavelet decoding consecutive frames of said modified stream of frames to construct a modified digitised time domain audio signal which, on playback, approximates pitch of said digitised time domain audio signal but has a different speaking rate.

10. The method of claim 9 wherein said step of wavelet decoding comprises sub-band decoding.

11. Apparatus for changing the speaking rate in respect of a digitised time domain audio signal which has been transformed into a wavelet coded audio signal comprising a stream of wavelet coded frames, comprising:

means for selecting periodic pairs of adjacent frames of said wavelet coded audio signal;

means for modifying said wavelet coded audio signal by dropping said selected pairs of adjacent frames from said wavelet coded audio signal to leave a stream of frames or replicating said selected pairs of adjacent frames in said wavelet coded audio signal to form a stream of frames including each replicated pair of adjacent frames; and means for wavelet decoding consecutive frames of said modified stream of frames to construct a modified digitised time domain audio signal which, on playback, approximates pitch of said digitised time domain audio signal but has a different speaking rate.

12. The apparatus of claim 11 including a user input for outputting an indication of a selecting period and wherein said means for selecting is responsive to an output of said user input.

* * * * *